US005996789A

United States Patent [19]

Suggs et al.

[11] Patent Number: 5,996,789

[45] Date of Patent: Dec. 7, 1999

[54] GOLF BAG WITH AUTOMATIC STAND AND FULL LENGTH DIVIDERS

[75] Inventors: Gregory M. Suggs, Phoenix; Gregory J. Schmidt, Glendale; Leslie J. Bryant, Peoria, all of Ariz.

[73] Assignee: Karsten Manufacturing Corp., Phoenix, Ariz.

[21] Appl. No.: 09/139,477

[22] Filed: Aug. 25, 1998

[51] Int. Cl.[6] ..... A63B 55/00

[52] U.S. Cl. ..... 206/315.3; 206/315.7; 206/315.6; 248/96

[58] Field of Search ..... 206/315.3, 315.7, 206/315.6; 248/96

[56] References Cited

U.S. PATENT DOCUMENTS

| | | | |
|---|---|---|---|
| 2,551,780 | 5/1951 | Wood | 206/315.3 |
| 4,709,814 | 12/1987 | Antonious | 206/315.3 |
| 4,834,235 | 5/1989 | Solheim | 206/315.7 |
| 5,178,273 | 1/1993 | Igarashi | 206/315.7 |
| 5,209,350 | 5/1993 | Maeng | 206/315.7 |
| 5,901,845 | 5/1999 | Cheng | 206/315.7 |

*Primary Examiner*—Gary E. Elkins
*Assistant Examiner*—Tri M. Mai
*Attorney, Agent, or Firm*—Darrell F. Marquette

[57] ABSTRACT

A golf bag includes a container and a stand. The container has an elongated body which defines an interior space for receiving golf clubs, and a partition member disposed inside the body divides the interior space into a plurality of individual compartments. A throat member is attached to an upper end of the body, and a hinge connects a base member to a lower end of the body. The hinge permits pivoting movement of the body relative to the base member from an upright position to an inclined position. During this pivoting movement of the body, a lower edge on the body lower end moves toward an upper edge on the base member. When the body is in its upright position, a wedge-shaped gap is formed between the lower edge on the body lower end and the upper edge on the base member. The wedge-shaped gap is closed as the body moves from its upright position to its inclined position. A stand, which includes a pair of legs pivotally connected to the throat member, supports the body in its inclined position.

23 Claims, 5 Drawing Sheets

GOLF BAG WITH AUTOMATIC STAND AND FULL LENGTH DIVIDERS

BACKGROUND OF THE INVENTION

The present invention relates generally to golf equipment and, more particularly, to a golf bag for carrying golf clubs.

For many years, golf clubs have been carried in specially designed golf bags. Most golf bags consist of a tubular container approximately three feet in length and of generally cylindrical configuration with a closed bottom and an open top through which golf clubs are inserted into and removed from the container. The top usually includes a throat member that is divided into a plurality of sections in order to segregate golf clubs into selected groups. Additionally, golf bags usually include pockets for carrying golf balls, tees and the like. A handle and a shoulder strap are also provided to facilitate carrying a golf bag.

Although some golfers carry their golf bags while playing, many of them dislike repeatedly bending over whenever the golf bag they are carrying must be laid down or picked up from the ground during the course of play. Further, most golfers dislike laying their golf bags down in wet grass or dirt. For these reasons, various stands have been devised for supporting golf bags in an inclined position whenever a golfer desires. One such stand is disclosed in U.S. Pat. No. 4,834,235 to John A. Solheim et al and includes legs that are automatically extensible by utilizing a golf bag with a collapsible side.

Recently, golfers have desired golf bags with dividers that extend substantially the full length between the top and bottom of the bag. These full length dividers provide improved segregation of golf clubs into selected groups but it has become difficult to incorporate them into a golf bag that utilizes the stand disclosed in the above-mentioned Solheim et al patent.

Therefore, a need exists for an improved golf bag with an automatic stand and full length dividers.

SUMMARY OF THE INVENTION

The present invention provides a golf bag comprising a container including an elongated body defining an interior space for receiving golf clubs. The body has an upper end and a lower end. The body lower end includes a lower edge. The container also includes a base member having an upper edge and forming a closed bottom for the container, and hinge means connects the body lower end to the base member for permitting pivoting movement of the body relative to the base member from an upright position to an inclined position. During this pivoting movement of the body, the lower edge of the body lower end moves toward the upper edge of the base member. A stand is connected to the body for supporting the body in the inclined position.

In the preferred embodiment of the golf bag, the container further includes a throat member attached to the body upper end. A partition member is disposed inside the body extending between the body upper and lower ends thereof for dividing the interior space into a plurality of individual compartments. A wedge shaped gap is formed between the lower edge of the body lower end and the upper edge of the base member. The wedge shaped gap closes as the body moves from its upright position to its inclined position.

DESCRIPTION OF THE PREFERRED EMBODIMENT

Figure 1:
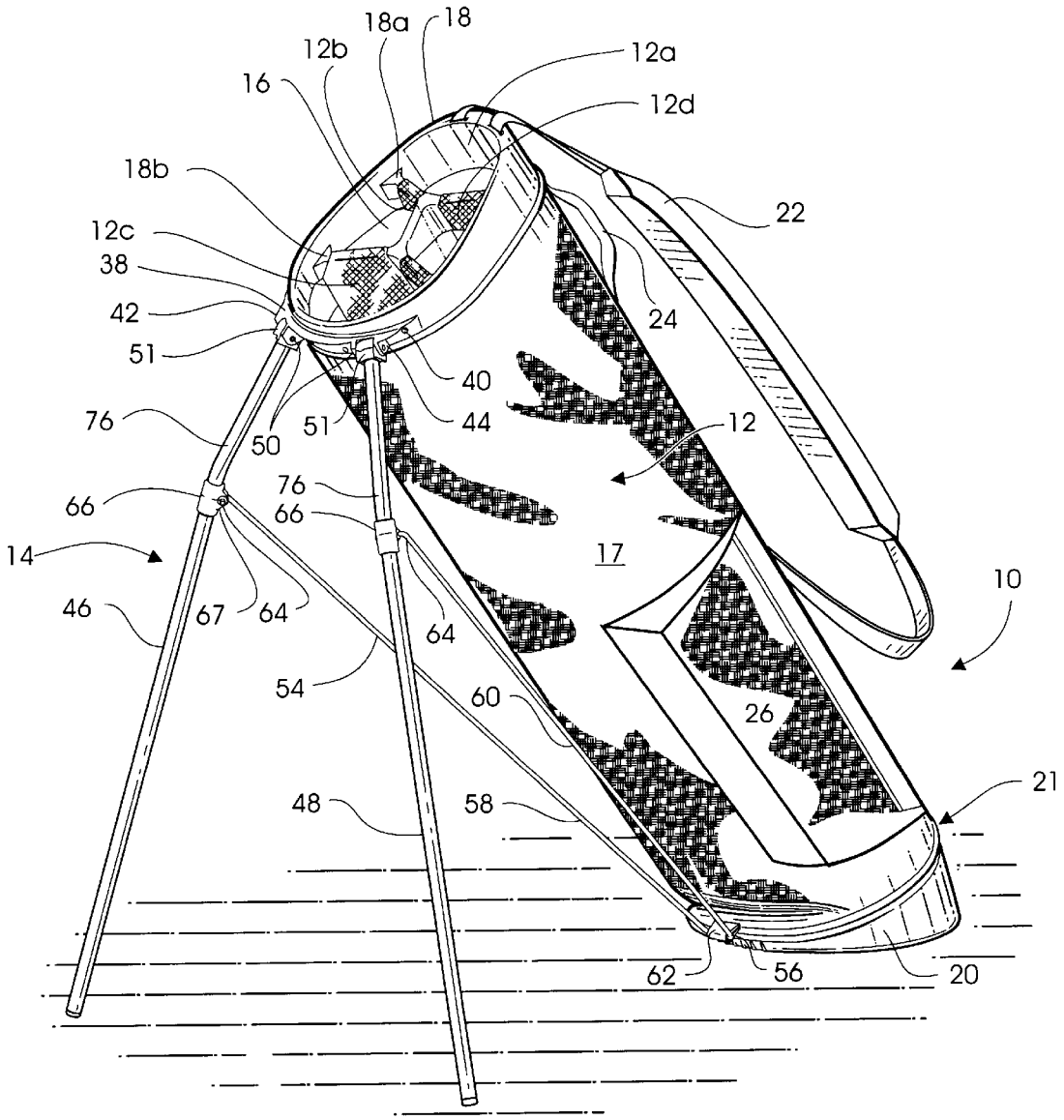
FIG. 1 is a perspective view of a golf bag including a container and a stand according to one embodiment of the present invention.
Figure 2A:
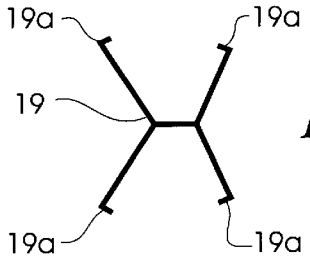
FIG. 2*a* is a sectional view taken along lines 2*a*—2*a* in FIG. 2.
Figure 2:
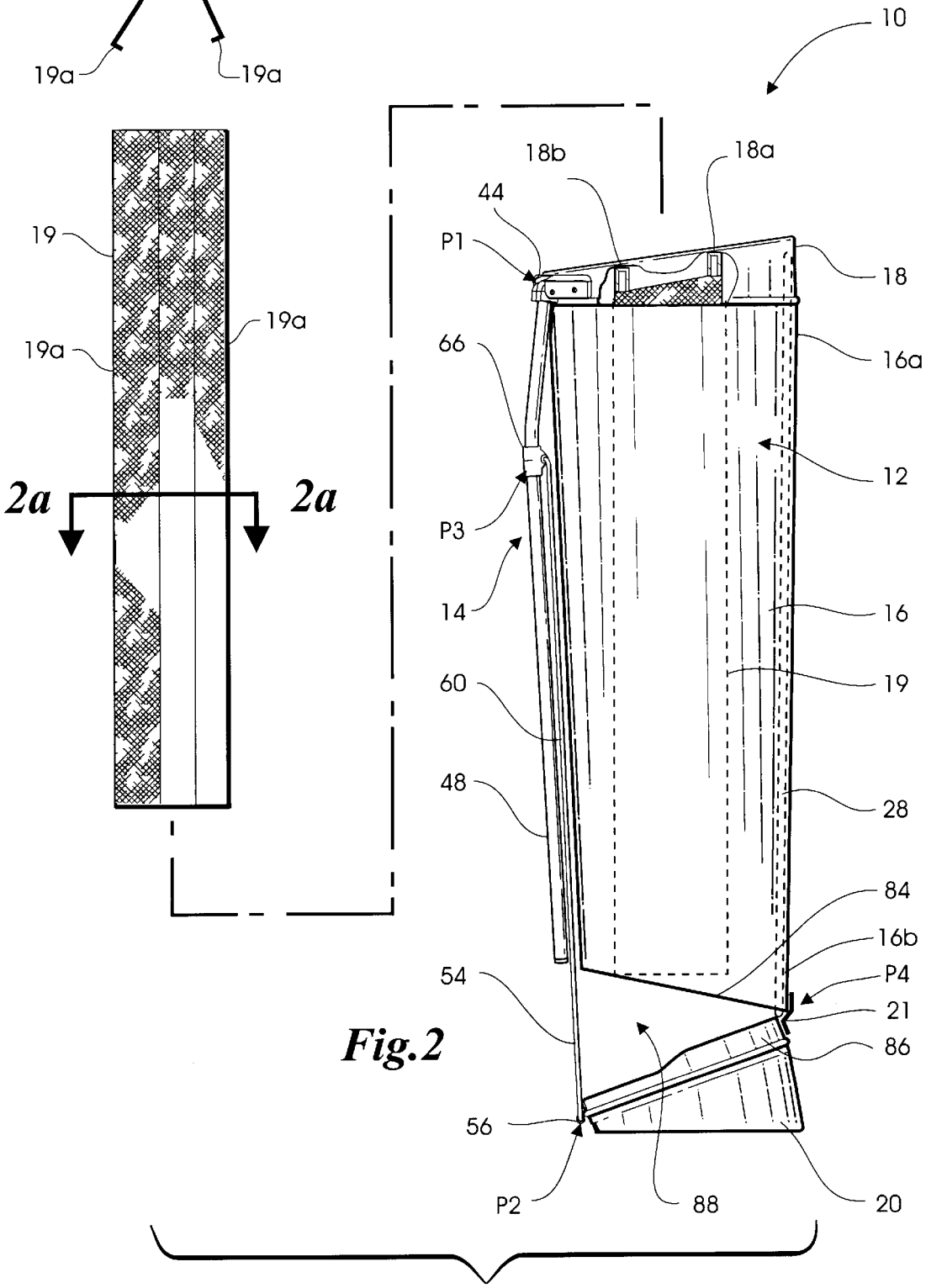
FIG. 2 is a side elevational view of the golf bag shown in FIG. 1 with the container partially disassembled.

FIGS. 1 and 2 show a golf bag 10 comprising a container 12 and a stand 14 according to one embodiment of the present invention. Container 12 includes an elongated body 16 formed of semi-rigid material such as polypropylene, polyethylene or other suitable plastic. Body 16 defines an interior space for receiving golf clubs, and body 16 is covered on its exterior by an outer layer 17 of lightweight fabric such as nylon, polyester or similar fabric material which is attached to body 16. A throat member 18 such as shown in U.S. Pat. No. 4,596,328 having V-shaped cross bars 18*a* and 18*b* is securely mounted, preferably by sewing or by rivets, to an upper end 16*a* of the body 16 thereby forming an open top for the container 12. A partition member 19 (FIG. 2), which forms substantially full length dividers, is disposed inside the body 16 immediately below throat member 18. Outer edge portions 19*a* of the partition member 19 are attached to the body 16 by sewing, and the partition member 19 may be attached to cross bars 18*a* and 18*b* by clips (not shown). Partition member 19 in conjunction with throat member 18 divides the interior space defined by the body 16 into four individual compartments 12*a*, 12*b*, 12*c* and 12*d* wherein golf clubs (not shown) are segregated into desired groups. The golf clubs will be inserted into and removed from the container 12 through the throat member 18 as is customary.

A base member 20, forming a closed bottom for the container 12 and shaped such as shown in U.S. Pat. No. Des. 372,362 incorporated herein by reference, is connected to a lower end 16*b* of the body 16 by a hinge 21 to permit movement of the body 16 relative to the base member 20 as described more fully later. Hinge 21 may be comprised of a strip of flexible material, such as polyester or any other suitable fabric, and it may be connected directly between body 16 and base member 20. Alternatively, hinge 21 may be connected between base member 20 and outer covering 17. Both the throat member 18 and the base member 20 are preferably molded of a suitable synthetic resin.

The golf bag 10 may also include various other features such as a shoulder strap 22, a handle 24, and an accessory pocket 26. A strut 28 in the form of an elongated dowel may be secured inside body 16 to provide additional rigidity. Strut 28 may be fabricated of wood, fiberglass, or other suitable rigid material, preferably extending between upper and lower ends of body 16. Alternatively, rigidifying strut 28 may be formed as a molded-in feature of body 16.

The stand 14, constructed such as disclosed in U.S. Pat. No. 4,834,235 and incorporated herein by reference, includes a mounting bracket 38 having an arcuate strap member 40 that is riveted or otherwise securely attached to throat member 18. Mounting bracket 38 is configured to provide a spaced apart pair of devises 42 and 44 which are disposed so as to extend radially from the throat member 18 and thus diverge from each other. The stand 14 also includes a pair of legs 46 and 48 pivotally mounted at their upper ends to the clevis members 42 and 44, respectively, by pivot pins 50. The stand 14 further includes an actuator rod 54 of substantially U-shaped configuration having an intermediate portion 56 and a pair of arms 58, 60 which extend upwardly from opposite ends of the intermediate portion 56. The actuator rod 54 is pivotally attached to base member 20 by a bearing 62 which may consist of a fabric loop in which the intermediate portion 56 of the actuator rod 54 is disposed.

The arms 58, 60 of the actuator rod 54 have their top ends 64 bent inwardly toward each other to facilitate connection to the legs 46, 48. Collars 66 are secured to the legs 46, 48 at points proximate but spaced below the upper ends of the legs 46, 48. Each collar 66 includes a transverse bearing 67 which receives the arm top ends 64 to accomplish the pivotal connection of the arms 58, 60 to the legs 46, 48. Actuator rod 54 is preferably made of steel rod stock having some inherent spring quality. Prior to assembly, top ends 64 of arms 58, 60 are preformed so that they are spaced slightly closer together than collars 66 on legs 46, 48. Accordingly, arm top ends 64 must be pulled apart to be inserted into bearings 67. Thus, when the arms 58 and 60 of the actuator rod 54 are connected to the collars 66, the arm top ends 64 are biased into the bearings 67. This biasing eliminates the need for any additional fasteners that may otherwise be required to retain the arm top ends 64 in pivotal connection with the collars 66. In addition, this biasing aids in automatically returning the legs 46 and 48 from their extended position shown in FIG. 3 to their retracted position shown in FIG. 2. The legs 46 and 48 are bent slightly as at 76 immediately above collars 66. This ensures that the bottom ends of the legs 46 and 48 will lie flat against the side of the body 16 when in their retracted positions as seen in FIG. 2.

Figure 3:
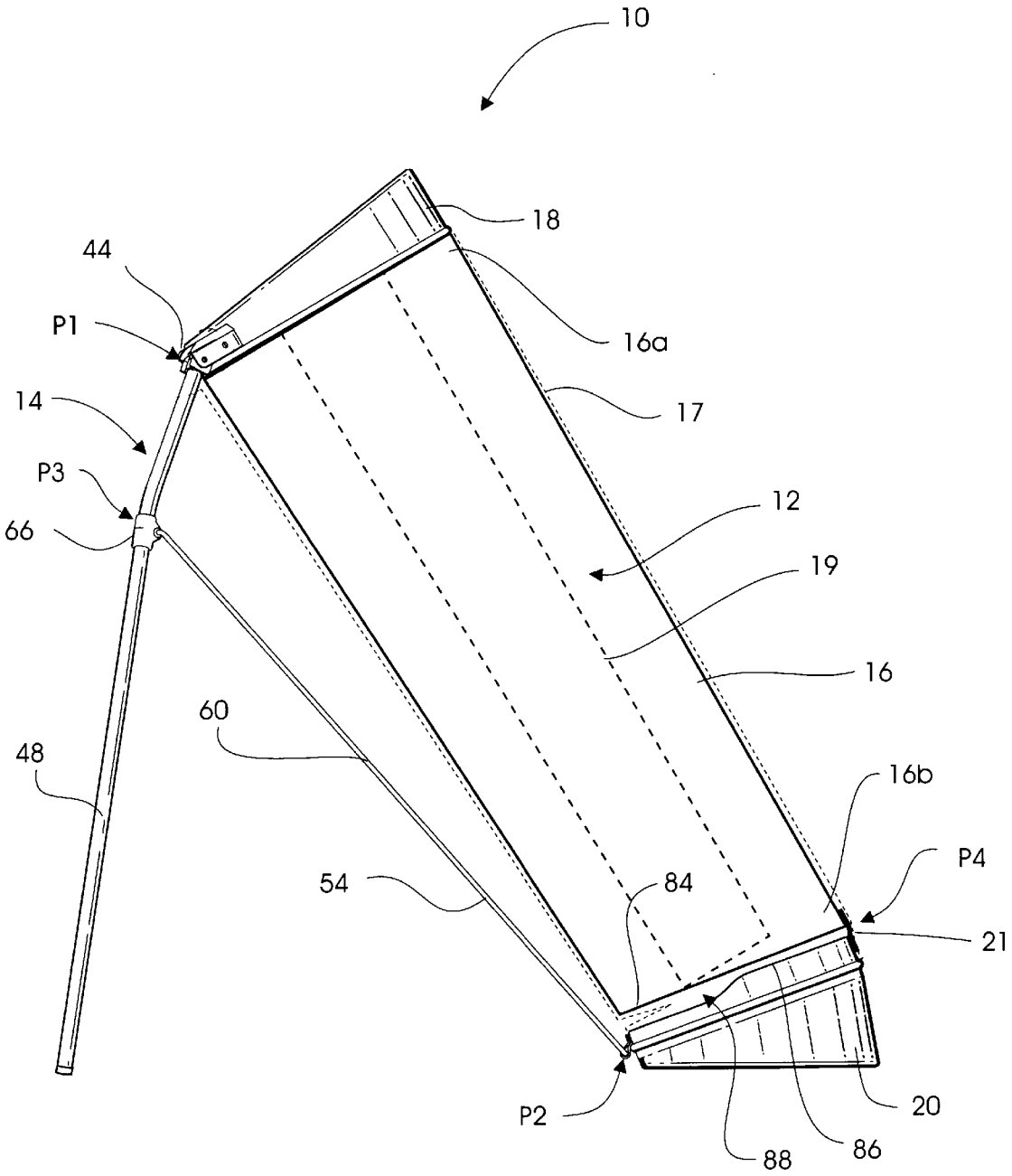
FIG. 3 is another side elevational view of the golf bag shown in FIG. 1 with the container supported by the stand.

In order to clearly understand the automatic operation of the stand 14, reference is now made to FIGS. 2 and 3. For purpose of this description, the pivotal connection of the legs 46 and 48 to the throat member 18 at devises 42, 44 will be identified as first pivot points P1. The pivotal connection of the intermediate portion 56 of the actuator rod 54 to the base member 20 at bearings 62 forms a second pivot connection P2, and the pivotal connection of the actuator rod arms 58, 60 to the legs 46 and 48 at collars 66 provides third pivot points P3. The hinge 21 connecting body 16 and base member 20 provides a fourth pivot point P4.

When the body 16 is in an upright position as shown in FIG. 2, it rests on the base member 20. Extending from the fourth pivot point P4, a lower annular edge 84 of body lower end 16*b* and an upper annular edge 86 of base member 20 diverge from each other such that a substantially wedge-shaped gap 88 is formed therebetween. In this upright position of body 16, the distance between first pivot points P1 and the second pivot point P2 will be at a maximum and the third pivot point P3 will be generally aligned with the first and second pivot points P1 and P2 along one side of the body 16. Thus, legs 46 and 48 will be in their retracted positions where their bottom ends lie against body 16.

When the body 16 is to be supported by the stand 14 in an inclined position as shown in FIG. 3, body 16 is pivoted at hinge 21 relative to base member 20 thereby causing the wedge shaped gap 88 to close since the lower annular edge 84 moves toward the upper annular edge 86. As body 16 moves to its inclined position, the distance between first and second pivot points P1 and P2 is reduced resulting in third pivot points P3 being pushed away from the body 16 in a motion that is a toggle action of the actuator rod 54 which automatically extends the legs 46 and 48. The portion of the outer layer 17 adjacent the wedge shaped gap 88 folds as the body 16 moves from its upright position to its inclined position. If the golf bag 10 is subsequently lifted by utilizing the shoulder strap 22 or the handle 24, the actuator rod 54 will automatically return the legs 46, 48 to their retracted position. Consequently, the wedge shaped gap 88 will open as the lower annular edge 84 moves away from the upper annular edge 86.

Figure 4:
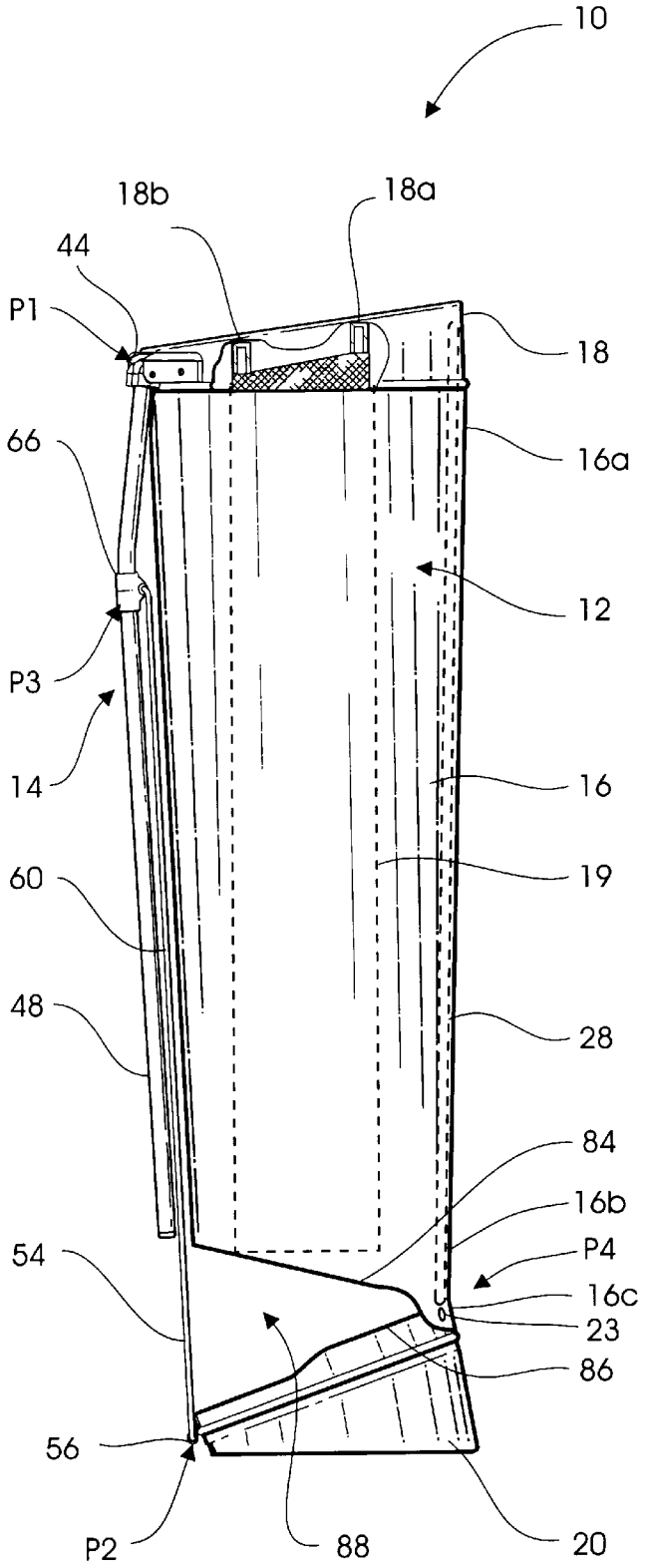
FIG. 4 is a side elevational view similar to FIG. 2 illustrating an alternative embodiment of the present invention.
Figure 5:
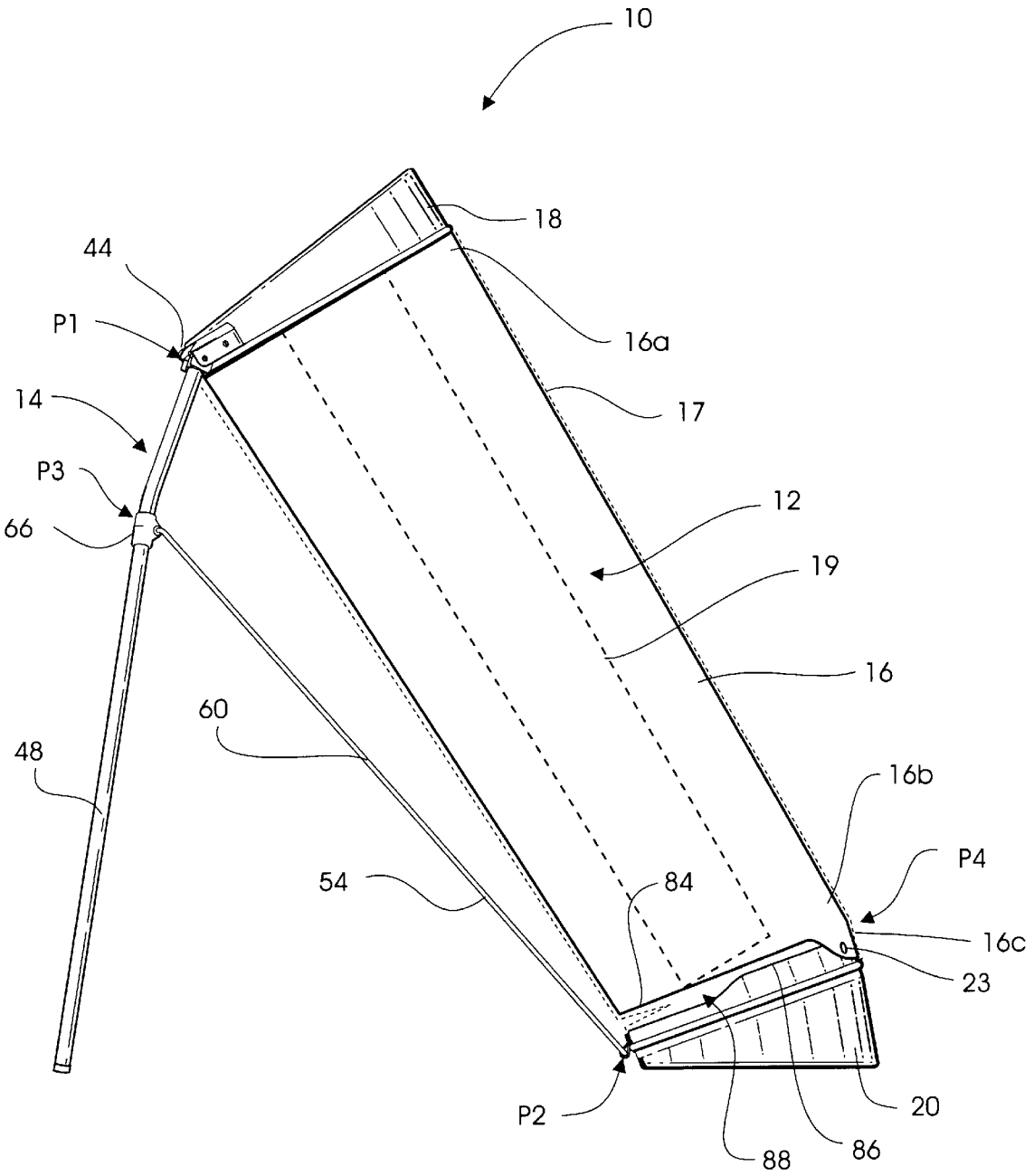
FIG. 5 is a side elevational view similar to FIG. 3 illustrating the alternative embodiment shown in FIG. 4.

Referring to FIGS. 4 and 5, an alternative embodiment of the golf bag 10 is illustrated. In this embodiment, the hinge 21 has been replaced by an extension 16*c* on the body lower end 16*b* which is attached by conventional means such as rivets 23 or stitching (not shown) to the base member 20. When the body 16 is pivoted relative to the base member 20 from its upright position in FIG. 4 to its inclined position in FIG. 5, the body lower end extension 16*c* flexes and thus serves as a hinge. This flexing of the body lower end extension 16*c* permits the lower edge 84 of the body lower end 16*b* to move toward the upper edge 86 of the base member 20 thereby closing the wedge shaped gap 88.

What is claimed is:

1. A golf bag comprising:

a container including an elongated body defining an interior space for receiving golf clubs, said body having an upper end and a lower end, said body lower end including a lower edge;

said container also including a base member forming a closed bottom for said container, said base member having an upper edge;

hinge means connecting said body lower end to said base member for permitting pivoting movement of said body relative to said base member from an upright position to an inclined position while said lower edge of said body lower end moves toward said upper edge of said base member; and a stand connected to said body for supporting said body in said inclined position.

2. The golf bag of claim 1, wherein a wedge-shaped gap is formed between said lower edge of said body lower end and said upper edge of said base member when said body is in said upright position.

3. The golf bag of claim 2, wherein said wedge-shaped gap is closed as said body moves from said upright position to said inclined position.

4. The golf bag of claim 1, further comprising a partition member disposed inside said body extending between said upper and lower ends thereof for dividing said interior space into a plurality of individual compartments.

5. The golf bag of claim 1, further comprising an outer layer attached to and covering said body.

6. The golf bag of claim 5, wherein said hinge means is formed by attaching said outer layer to said base member.

7. The golf bag of claim 6, wherein said outer layer is formed of flexible material.

8. The golf bag of claim 1, wherein said container further comprises a throat member attached to said body upper end forming an open top for said container through which golf clubs may be inserted into and removed from said interior space.

9. The golf bag of claim 8, wherein said partition member is attached to said body along its length, and wherein said partition member is also attached to said throat member.

10. The golf bag of claim 9, wherein said throat member has at least one cross bar.

11. The golf bag of claim 8, wherein said stand comprises a pair of legs pivotally connected to said throat member.

12. The golf bag of claim 11, wherein said stand further comprises an actuator rod pivotally connected between said base member and said legs for moving said legs from a retracted position to an extended position when said body is moved from said upright position to said inclined position.

13. The golf bag of claim 12, wherein the pivotal connection between said legs and said throat member defines first pivot points, the pivotal connection between said actuator rod and said base member defines a second pivot point, the pivotal connection between said actuator rod and said legs defines third pivot points, and said hinge means defines a fourth pivot point.

14. The golf bag of claim 13, wherein said first, second and third pivot points are generally aligned with respect to each other along one side of said body when said, body is in said upright position.

15. The golf bag of claim 14, wherein said first pivot points are moved closer to said second pivot point when said body moves from said upright position to said inclined position.

16. The golf bag of claim 15, wherein said third pivot points are moved farther away from said fourth pivot points as said first pivot points are moved closer to said second pivot points thereby automatically moving said legs from said retracted position to said extended position.

17. The golf bag of claim 16, wherein said fourth pivot point is located on an opposite side of said body.

18. The golf bag of claim 17, further comprising a rigidifying strut extending between said body upper and lower ends along said opposite side of said body.

19. The golf bag of claim 17, wherein said hinge means comprises a strip of flexible material connected between said body lower end and said base member.

20. The golf bag of claim 17, wherein said hinge means comprises an extension on said body lower end which is connected to said base member, and wherein said extension flexes when said body moves from said upright position to said inclined position.

21. A golf bag comprising:

a container including an elongated body defining an interior space for receiving golf clubs, said body also having an upper end and a lower end, said body lower end including a lower edge;

said container also including a throat member and a base member, said throat member being attached to said body upper end forming an open top for said container through which golf clubs may be inserted into and removed from said interior space, said base member forming a closed bottom for said container and having an upper edge;

hinge means connecting said body lower end to said base member for permitting movement of said body relative to said base member from an upright position to an inclined position while said lower edge of said body lower end moves toward said upper edge of said base member;

a wedge-shaped gap formed between said lower edge of said body lower end and said upper edge of said base member when said body is in said upright position;

a partition member disposed inside said body extending between said upper and lower ends thereof for dividing said interior space into a plurality of individual compartments; and a stand including a pair of legs pivotally connected to said throat member for supporting said body in said inclined position.

22. The golf bag of claim 21, wherein said hinge means comprises a strip of flexible material connected between said body lower end and said base member.

23. The golf bag of claim 21, wherein said hinge means comprises an extension on said body lower end which is connected to said base member, and wherein said extension flexes when said body moves from said upright position to said inclined position.

* * * * *